US005169709A

United States Patent [19]

Fleischer

[11] Patent Number: 5,169,709

[45] Date of Patent: Dec. 8, 1992

[54] PAPER MACHINE FORMING FABRIC WITH CONTROLLED POROSITY

[75] Inventor: Thomas B. Fleischer, Pelzer, S.C.

[73] Assignee: Wangner Systems Corporation, Greenville, S.C.

[21] Appl. No.: 777,728

[22] Filed: Oct. 16, 1991

[51] Int. Cl.[5] ..... D03D 3/00

[52] U.S. Cl. ..... 428/225; 139/383 A; 162/348; 428/229; 428/255; 428/257; 428/258

[58] Field of Search ..... 139/383 A; 162/DIG. 1, 162/348; 428/257, 258, 225, 229, 255

[56] References Cited

U.S. PATENT DOCUMENTS 4,640,741 2/1987 Tsuneo ..... 428/225
4,909,284 3/1990 Hositzke ..... 428/224
5,056,565 10/1991 Kufferath ..... 139/383 A

*Primary Examiner*—James J. Bell
*Attorney, Agent, or Firm*—Cort Flint

[57] ABSTRACT

A multi-layer paper machine fabric having a preselected permeability value and an increased weft wise stiffness including a single system of warp threads and multiple layers of weft threads including at least support surface weft threads, intermediate layer weft threads and lower surface weft threads interwoven with the warp threads. The surface layer weft threads are arranged to have at least a first thickness and the intermediate layer and lower surface weft threads are arranged to have a second and equal thickness greater than the first thickness of the surface layer weft threads. The second thickness is selected relative to the first thickness to achieve the preselected permeability value and the preselected weft wise stiffness value of the paper machine fabric. Alternate ones of the support layer weft threads are arranged in vertically stacked rows with the intermediate and lower layer weft threads and intermediate ones of the support layer weft threads are arranged between the vertical rows.

18 Claims, 3 Drawing Sheets

PAPER MACHINE FORMING FABRIC WITH CONTROLLED POROSITY

BACKGROUND OF THE INVENTION

In modern paper forming machines, the machine capacity is limited by the capabilities of the paper forming fabric. Attempts in the past have been made to provide stable multi-layer paper forming fabrics having desired stability and drainage capabilities.

U.S. Pat. No. 4,867,206 discloses a paper forming fabric having vertically stacked weft yarns woven with a plurality of layers of warp yarns to produce drainage channels which increase in size from the support surface.

U.S. Pat. No. 4,379,735 discloses a paper forming fabric having increased cross machine stiffness by using three layers of stacked weft yarns.

U.S. Pat. No. 4,909,284 discloses a multi-layered forming fabric having a single warp system woven with two layers of stacked weft. Te lower weft layer of weft yarns are of larger diameter than that upper weft layer.

U.S. Pat. No. 4,640,741 is directed to a paper forming fabric in which a double layer warp system is woven with three layers of weft stacked yarns. The upper layer weft yarns are the smaller diameter yarns, the lower layer weft yarns are the intermediate diameter yarns and the intermediate layer weft yarns are the larger diameter yarns. The fabric stiffness and porosity are controlled by varying the thickness of the intermediate layer weft yarns.

It is an object of the instant invention to overcome the drawbacks of the prior art arrangements.

It is a further object of the invention to provide a stable paper forming fabric of constant weft count and controlled porosity.

It is a further object of the invention to provide a paper forming cloth having high cross machine or weft wise stiffness.

It is a further object of the invention to provide a paper forming fabric having a dense support surface so as to produce a minimum of wire markings and maximum of fiber retention on paper web.

SUMMARY OF THE INVENTION

A multi-layer paper machine fabric having a preselected permeability value of between 200 and 800 CFM and a preselected weft wise stiffness value is formed. The fabric comprises a single system of warp threads and multiple layers of weft threads including at least support surface weft threads, intermediate layer weft threads and lower surface weft threads, all interwoven with the warp threads. The surface layer weft threads are of at least a first thickness, the intermediate layer and lower surface weft threads are of a second thickness greater than the first thickness of the surface layer weft threads. The second thickness is selected relative to the first thickness to achieve the preselected permeability value and the preselected weft wise stiffness value.

The multi-layer paper forming fabric is heat set under tension to provide stability.

The count of the support surface weft threads is twice that of the intermediate and lower layer weft threads. At least alternate ones of the support layer weft threads are arranged in vertically stacked rows with the intermediate and lower layer weft threads.

The warp threads and certain of the support surface weft threads are of substantially an equal thickness of between 0.12 mm and 0.19 mm. Certain other, of the support weft threads are of a smaller thickness of between 0.12 mm and 0.16 mm.

The intermediate layer and the support layer weft threads of the multi-layer fabric are preferably polyester monofilaments which provide greater stability and stiffness. The lower layer weft threads may alternatively be polyamide monofilaments for greater wear resistance. Each of these weft threads are of the greater second thickness selected to achieve a high degree of weft wise stiffness and a preselected permeability value. The thickness of the intermediate and lower layer weft threads is between 0.18 mm to 0.26 mm.

The weft count of the multi-layer fabric remains constant while the permeability factor is adjusted between 200 to 800 CFM as desired.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
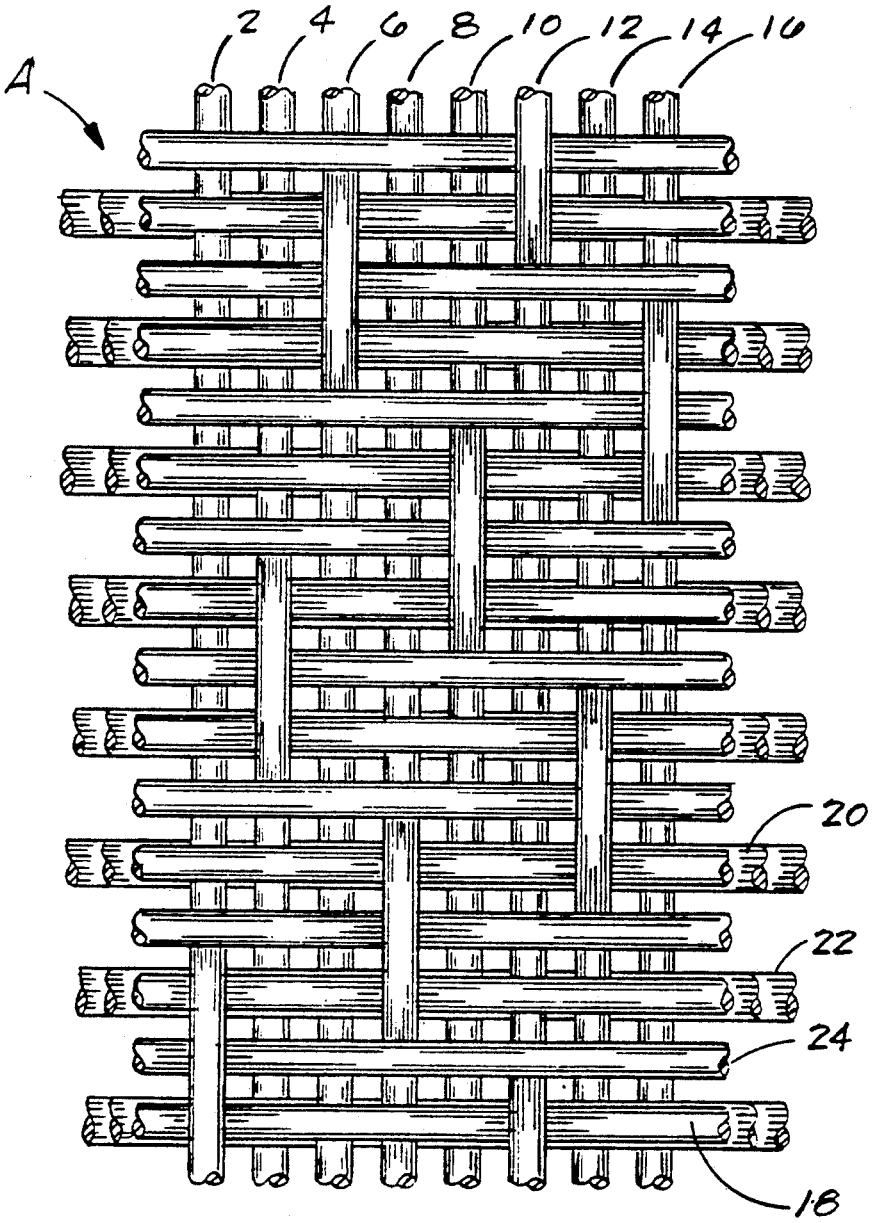
FIG. 1 is a sectional top view of a paper forming fabric according to the invention showing a complete repeat of the weave pattern.
Figure 2:
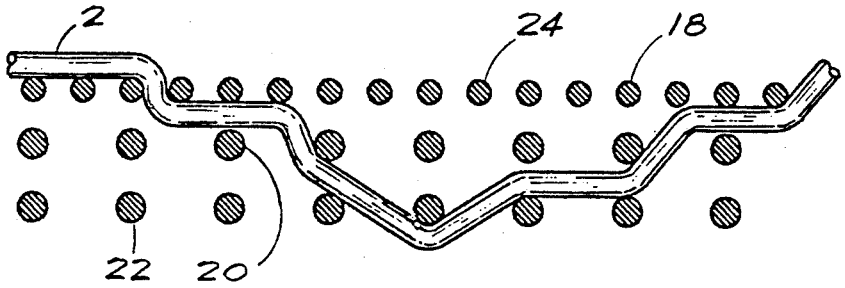
FIGS. 2 through 5 are sectional side views showing the warp weft relationship for the first four warp threads as indicated in FIG. 6.
Figure 3:
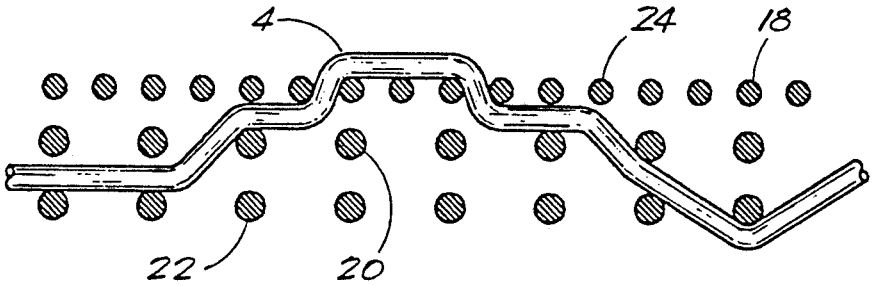
Figure 4:
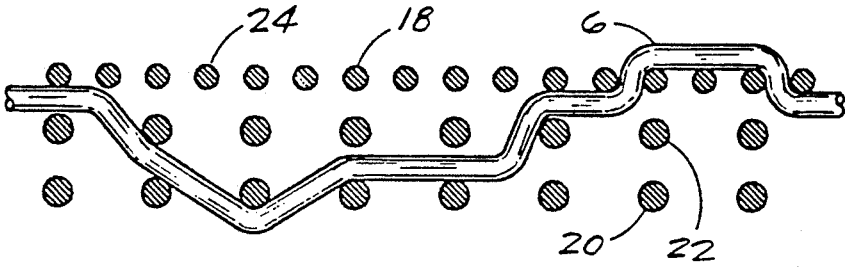
Figure 5:
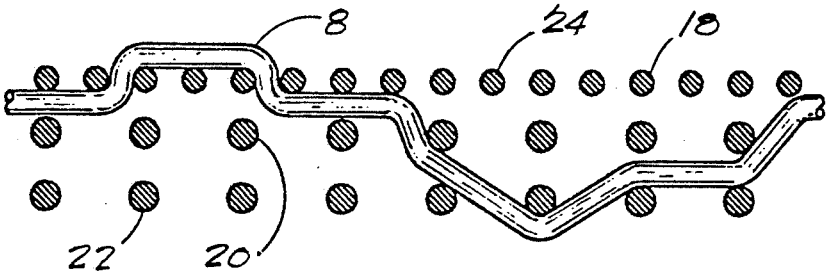

A multi-layer paper forming fabric A, according to the invention is shown in FIGS. 1 through 5. As seen in the figures a single layer of Warp threads 2, 4, 6, 8, 10, 12, 14 and 16 interweave with three separate layers of weft threads. The upper or paper support layer consists of weft threads 18 and 24. The intermediate layer is formed with weft threads 22 and the lower layer is formed with weft threads 20.

In order to provide a smooth and more dense support surface having a high degree of fiber retention weft threads 24 and 18 are normally smaller in diameter or thickness than lower and intermediate weft threads 20 and 22. The warp threads 2 through 16 are normally of the same diameter or thickness as weft threads 18 and 24. It is desired that weft threads 18 and 24 along with warp threads 2 through 16 have a thickness between 0.12 mm and 0.18 mm. The preferred thickness of these threads is 0.17 mm. The intermediate and lower weft threads have a thickness of between 0.18 mm and 0.26 mm with a preferred thickness of 0.22 mm.

Alternatively, weft threads 24 of the support surface weft threads may be of a smaller thickness than support surface weft threads 18 and the warp threads. Preferred examples are weft threads 18 having a thickness of 0.16 mm while weft threads 24 are 0.12 mm thick. Another example is for weft threads 18 to have a thickness of 0.19 mm while the thickness of threads 24 is 0.15 mm.

It is preferred that warp threads 2 through 16 and weft threads 18 and 24 of the support layer are monofilament polyester threads so as to provide a smooth and stable support surface. The intermediate and lower weft threads are also preferably polyester monofilament to provide greater stiffness and stability. It may be desirable to provide that weft threads 20 be a polyamide monofilament to provide additional wear resistance and workability.

Figure 6:
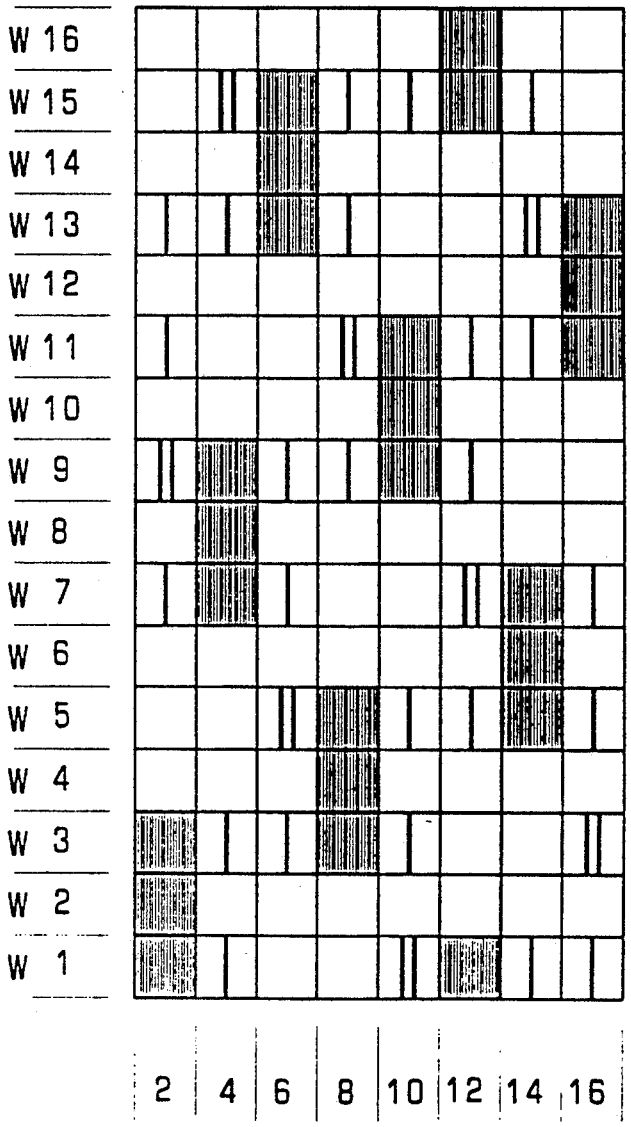
FIG. 6 is a weave diagram of a complete repeat of the weave pattern of the paper forming fabric of the invention.

Referring now to FIG. 6, there is shown the weave diagram of the forming fabric of the invention. As seen, the fabric requires sixteen weft threads for a repeat of the support surface as indicated as W-1 through W-16. The weaves repeat requires a total of thirty-two weft threads as shown in FIGS. 2–5. The warp threads are identified as 2, 4, 6, 8, 10, 12, 14 and 16. FIGS. 2 through 5 illustrate the path of warp threads 2, 4, 6 and 8 as they interlace with weft threads 18, 20, 22 and 24. Only the first four warp threads are shown in individual figures because FIG. 6 amply illustrates the path of the remainder of the warp threads.

After manufacture of fabric A by weaving, the fabric is heat set under tension to stabilize the fabric and to provide a uniform smooth surface having a high fiber retention percent for the support layer. Normally heat setting takes place at temperatures between 150° to 400° F. for from 15 to 60 minutes.

The porosity of paper forming fabric is measured in the cubic feet per minute at which air can pass through the fabric. The fabric of the invention has the capability of between 200 and 800 CFM. Fiber retention is measured in the percent of paper stock fibers retained on the first pass of the forming fabric. For light weight printing paper the fabric of the invention has a fiber retention percent of between 60% and 80%.

In order that the wire markings which are formed on the paper by the support surface of the paper forming fabric are at a minimum and are uniform, it is desirable that the weft count of the fabric remain constant. The weft count is the number of weft threads per inch or unit of measure. The weft count of the forming fabric of the invention is between 60 and 220 threads per inch with a weft count of 207 being preferred.

The desired CFM is achieved by varying the thickness of weft threads 20 and 22 relative to the other threads of the fabric. The greater the thickness of threads 20 and 22, the smaller the openings or channels formed between adjacent vertical stacks of weft threads. By controlling the size of these openings, the rate at which fluid may pass through the fabric is controlled. By maintaining constant the weft count of the fabric, the surface of the support layer remains relatively smooth and unchanged and the fiber retention remains constant.

It is desirable to provide a high degree of stiffness in the cross machine direction so that the fabric can resist deflection by the paper stock and the support elements. By providing that weft threads 20, 22 are monofilament of large size, stiffness of the fabric in the cross-machine direction is increased. Also, polyester monofilaments have a greater stiffness than polyamide monofilaments. When it is desired to provide maximum weft wise stiffness and yet maintain a satisfactory degree of wearability, weft threads 20 and 22 are formed of a polyester monofilament. Threads 20 may alternatively be polyamide monofilaments if increased wear resistance is desired.

The preferred material for the warp and weft threads is polyester and polyamide monofilaments, it is noted that other synthetic materials are also suitable for use with the fabric of the invention in particular yarn formed of PCP and polypropylene.

While a preferred embodiment of the invention has been described using specific terms, such description is for illustrative purposes only, and it is to be understood that changes and variations may be made without departing from the spirit or scope of the following claims.

What is claimed is:

1. A multi-layer paper machine fabric having a preselected permeability value and a increased weft wise stiffness comprising:

a single system of synthetic warp threads;

multiple layers of synthetic weft threads including at least support surface weft threads, intermediate layer weft threads and lower surface weft threads interwoven with said warp threads;

said surface layer weft threads having at least a first thickness;

said intermediate layer and lower surface weft threads having a second thickness greater than the first thickness of said surface layer weft threads, said second thickness being selected relative to said first thickness to achieve the preselected permeability value and the increased weft wise stiffness.

2. The multi-layer fabric of claim 1 wherein said fabric is heat set under tension to provide stability.

3. The multi-layer fabric of claim 1 wherein the count of the support surface weft threads is twice that of said intermediate and lower layer weft threads.

4. The multi-layer fabric of claim 1 wherein at least alternate ones of said support layer weft threads are arranged in vertically stacked rows with said intermediate and lower layer weft threads.

5. The multi-layer fabric of claim 1 wherein said warp threads and certain of said support surface weft threads are of substantially equal thickness.

6. The multi-layer fabric of claim 5 wherein said equal thickness is between 0.12 mm to 0.19 mm.

7. The multi-layer fabric of claim 1 wherein said intermediate layer and said lower layer of weft threads are polyester monofilaments, each of said greater second thickness selected to achieve increased weft wise stiffness factor and said preselected permeability value.

8. The multi-layer fabric of claim 7 wherein said second thickness is between 0.18 mm to 0.26 mm.

9. The multi-layer fabric of claim 1 wherein the support surface provides a paper product fiber retention of between 60% and 80%.

10. The multi-layer fabric of claim 1 wherein the weft count remains constant while the permeability factor is adjusted between 200 to 800 CFM as desired.

11. The multi-layer fabric of claim 1 wherein alternate ones of said support layer weft threads are arranged in vertically stacked rows with said intermediate and lower layer weft threads and intermediate ones of said support layer weft threads are arranged between said vertical rows.

12. The multi-layer fabric of claim 11 where in said intermediate weft threads are of less thickness than said alternate weft threads of said support layer.

13. The multi-layer fabric of claim 12 wherein said intermediate weft threads have a thickness of 0.12 mm and said alternate weft threads have a thickness of 0.16 mm.

14. A method of making a multi-layer paper machine fabric having a preselected permeability and a high weft wise stiffness comprising:

providing a single system of warp threads;

providing a multiple layer system of weft threads including support surface weft threads of at least a first thickness, intermediate weft threads and lower surface weft threads of a second and larger thickness;

weaving said single system of warp threads with said multi-layer system of weft threads so that said lower surface weft threads, said intermediate weft threads and at least alternate surface weft threads are arranged in vertical alignment and are maintained on their respective horizontal planes; and selecting said second thickness of a size to achieve said preselected permeability and weft wise stiffness.

15. A method of making a multi-layer fabric as set forth in claim 14 including the method of maintaining the surface layer weft threads at a constant thickness and count.

16. A method of making a multi-layer fabric as set forth in claim 14 including the step of maintaining the count of the fabric constant regardless of the selected thickness of said intermediate and lower layer weft threads.

17. A method of making a multi-layer fabric as set forth in claim 1 including the step of arranging intermediate weft threads of said surface layer of weft threads between said vertically arranged pairs of said intermediate layer weft threads, and said lower layer weft threads.

18. A method of making a multi-layer fabric according to claim 17 including selecting said intermediate weft threads of a smaller thickness than said alternate weft threads of said surface layer of weft threads.

* * * * *